United States Patent [19]

Lin

[11] Patent Number: 4,790,541

[45] Date of Patent: Dec. 13, 1988

[54] METHOD OF MANUFACTURING A DARTBOARD

[76] Inventor: Shih-Chung Lin, 5th Fl., No. 2, Alley 2, Lane 105, Jiun Kung Road, Mucha Dist., Taipei, Taiwan

[21] Appl. No.: 159,162

[22] Filed: Feb. 19, 1988

[51] Int. Cl.[4] ..... F41J 3/00

[52] U.S. Cl. ..... 273/408

[58] Field of Search ..... 273/408

[56] References Cited

U.S. PATENT DOCUMENTS 3,409,301 11/1968 Studen ..... 273/408

FOREIGN PATENT DOCUMENTS 462562 11/1937 United Kingdom ..... 273/408
545508 5/1942 United Kingdom ..... 273/408
553066 5/1943 United Kingdom ..... 273/408
579212 7/1946 United Kingdom ..... 273/408
593268 10/1947 United Kingdom ..... 273/408
602659 6/1948 United Kingdom ..... 273/408
611968 11/1948 United Kingdom ..... 273/408
611969 11/1948 United Kingdom ..... 273/408
639503 6/1950 United Kingdom ..... 273/408
981483 1/1965 United Kingdom ..... 273/408

OTHER PUBLICATIONS

N.Y. Sports & Games Ltd., Advertising Circular, Player Ready Dart Games, ©1982.

*Primary Examiner*—Paul E. Shapiro
*Attorney, Agent, or Firm*—Browdy and Neimark

[57] ABSTRACT

A bundle of skinned, longitudinally torn straws is cut transversely into pieces having predetermined thickness. The pieces are placed into an open topped dartboard contoured frame and compressed from top to bottom and around the periphery. The pieces are then allowed to expand and rearrange in the frame. The surface of the transverse pieces are surface-ground and marked to depict a dart target pattern. Finally, a netting which corresponds to the marked pattern is provided on the ground surface.

2 Claims, 2 Drawing Sheets

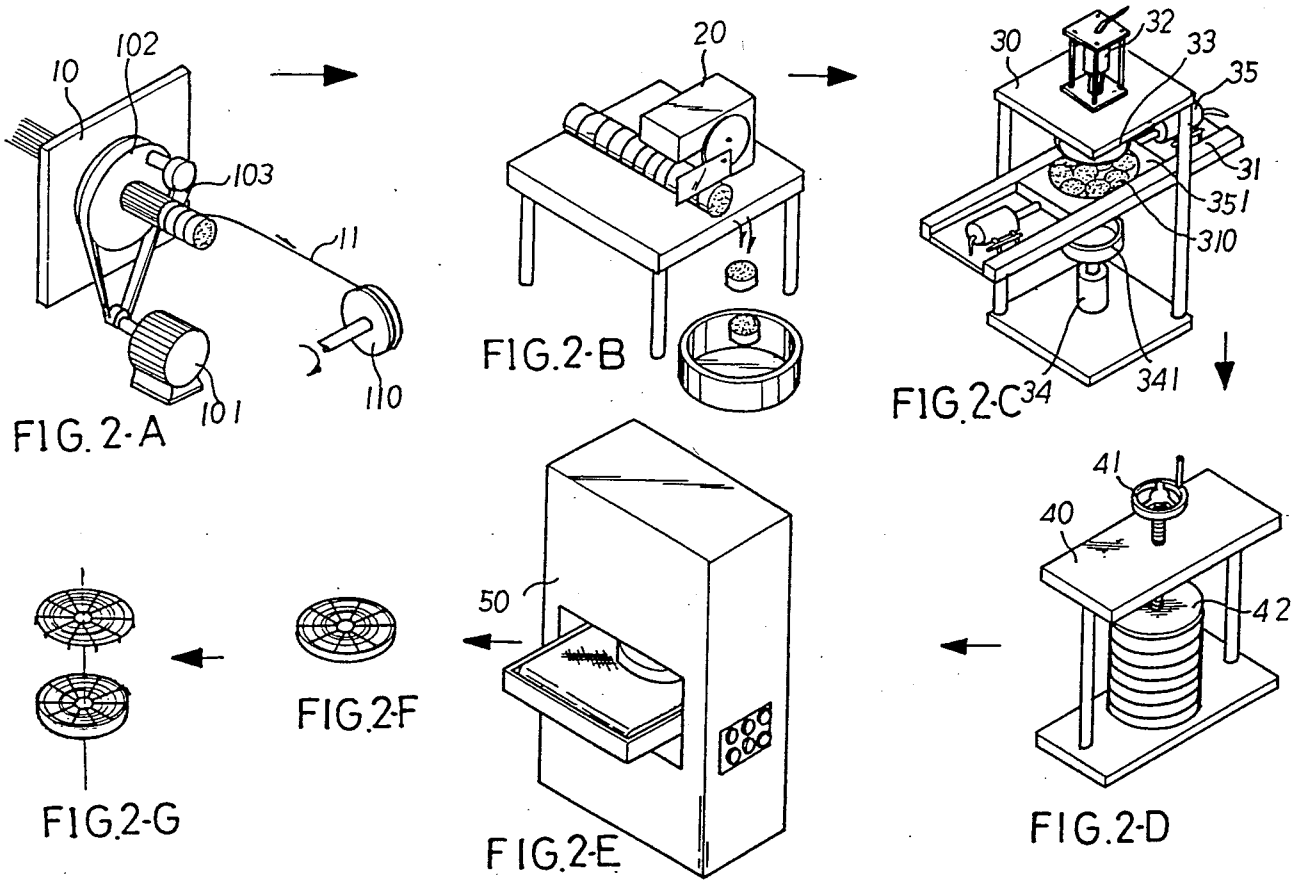
10
102
103
11
110
101
FIG. 2-A
20
FIG. 2-B
30
32
33
35
31
351
310
341
34
FIG. 2-C
40
41
42
FIG. 2-D
50
FIG. 2-E
FIG. 2-F
FIG. 2-G

METHOD OF MANUFACTURING A DARTBOARD

BACKGROUND OF THE INVENTION

The present invention relates to a dartboard, and more particularly to a dartboard capable of being used in cooperation with plastic darts.

Presently, the dartboard is made of sisal, which, however, is rare in some country, e.g. Republic of China on Taiwan, and thus is expensive and is supplied by importation. On the contrary, the rice-eating people e.g. the Taiwanese, has produced an enormous amount of straws which, nevertheless, find no gateway to utilization and can only be burnt into ashes to serve as a possible fertilizer which, however, will result in an air-pollution problem. It is therefore attempted by the Applicant to manufacture a dartboart made of straws.

SUMMARY OF THE INVENTION

It is therefore an object of the present invention to provide a dartboard having a reduced cost.

It is further an object of the present invention to provide a dartboard capable of being used incooperation with plastic darts.

According to the present invention, the dartboard is made of skinned straws torn into longitudinal pieces cut into transverse pieces juxtaposed together to constitute a dartboard.

The present invention may best be understood through the following description with reference to the accompanying drawings, in which:

BRIEF DESCRIPTION OF THE DRAWING

FIGS. 2A–2G are schematic views showing respective apparatuses used for the manufacture of a dartboard according to the present invention.

DETAILED DESCRIPTION OF THE PREFERRED EMBODIMENT

Figure 1:
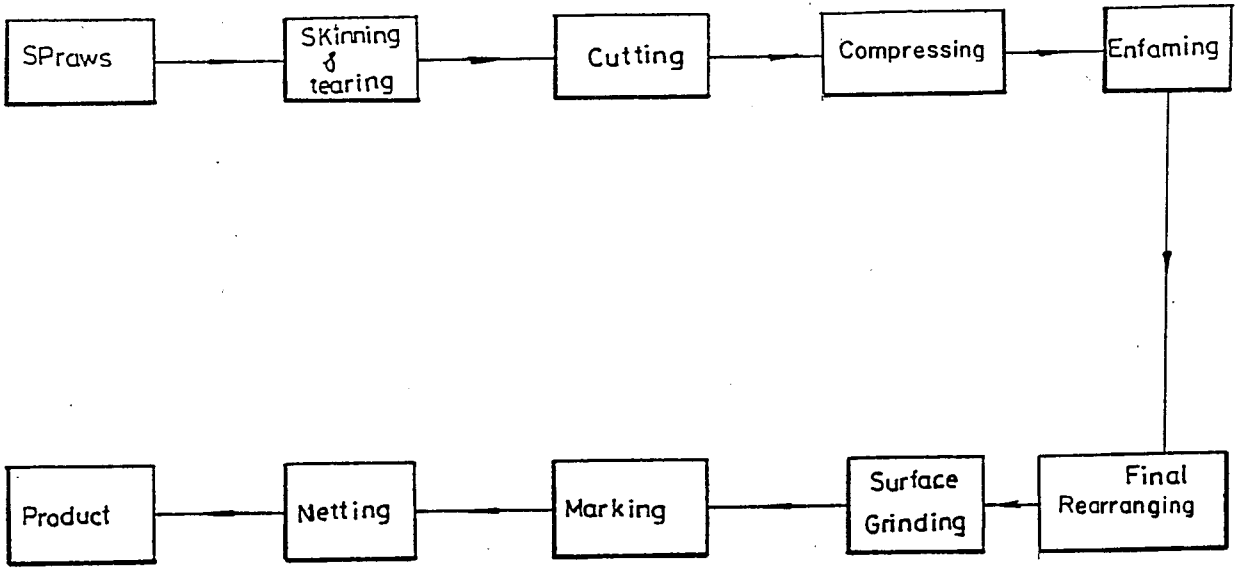
FIG. 1 is a flowchart showing a method of manufacturing a dartboard according to the present invention.

Referring now to FIG. 1, a method of manufacturing a dartboard according to the present invention includes the steps of (a) providing a bundle of skinned straws each of which is torn into longitudinal pieces, (b) transversely cutting the bundle of straws into pieces having a thickness slightly larger than that of a finished dartboard, (c) putting the transverse pieces in step (b) into a dartboard-contouring frame having an open top, (d) compressing the frame from the top and the bottom thereof and around the periphery thereof at a suitable force, e.g. 150 lbf, for a predetermined period of time, e.g. 20 seconds, (e) allowing segments of the longitudinal pieces in the transverse pieces to finally expand and rearrange in the frame for a suitable period of time, (f) surface-grinding the transverse pieces from the open end, (g) marking and coloring the transverse pieces on the ground surface thereof, and (h) providing a netting on the ground surface for better distinguishing the marking and coloring regions on the ground surface from one another.

FIGS. 2A–2G schematically show respective apparatuses used in connection with the present method. A bundle of longitudinally torn straws is inserted through a centrally holed plate 10 rotatably securing thereon a centrally holed wheel 102 which is driven by a motor 101 and fixes thereon an adhesive tape 103, and is pulled forward by a wire 11 fastened to a winding roller 110 so that it is wrapped in adhesive tape 103 lengthwise. A cutting machine 20 cutting the wrapped bundle into transverse pieces which are put into a dartboard-contouring frame having an open top which is positioned in a central hole 310 of a work plate 31 of a compressing apparatus 30 which compresses the dartboard-contouring frame from the top and bottom thereof through compressing media 33, 341 actuated by oil cylinders 32, 34 and around the periphery thereof through compressing media 351 actuated by oil cylinders 35. Rearranging apparatus 40 having a pressing plate 42 controlled by a handle wheel 41 allows segments of the longitudinal pieces in the transverse pieces to finally and possibly expand and rearrange in the dartboard-controuring frame. Each frame is sent to a grinder 50 for surface-grinding the transverse pieces from the open end. The ground surface of the transverse pieces in the frame is then marked and colored into regions. Finally, a netting corresponding to the marked and colored regions is placed on the ground surface of the transverse pieces in the dartboard-contouring frame.

While the present invention has been described in connection with what is presently considered to be the most practical and preferred embodiment it is to be understood that the invention is not to be limited to the disclosed embodiment but on the contrary, is intended to cover various modifications and equivalent arrangements included within the spirit and scope of the appended claims which scope is to be accorded the broadest interpretation so as to encompass all such modifications and equivalent structures.

What I claim is:

1. A method of manufacturing a dartboard comprising:

(a) providing a bundle of skinned straws each of which is torn into longitudinal pieces;

(b) transversely cutting said bundle of straws into pieces having a predetermined thickness;

(c) putting said transverse pieces in step (b) into a dartboard-contouring frame having an open top;

(d) compressing said frame from the top and bottom thereof and around the periphery thereof;

(e) allowing segments of said longitudinal pieces in said transverse pieces to finally expand and rearrange in said frame for a predetermined period of time;

(f) surface-grinding said transverse pieces from said open top; and (g) marking said transverse pieces on the ground surface thereof to obtain a final dartboard.

2. A method of manufacturing a dartboard as claimed in claim 1, further comprising:

(h) coloring said marked surface; and (i) providing a netting, which corresponds to the marking and coloring on said ground surface, on said ground surface.

* * * * *